US006148171A

United States Patent [19]

Kamijo

[11] Patent Number: 6,148,171

[45] **Date of Patent: *Nov. 14, 2000**

[54] CLEANING DEVICE FOR CLEANING RESIDUAL TONER FROM A PHOTOCONDUCTIVE ELEMENT

[75] Inventor: Masahiko Kamijo, Kawasaki, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/037,090

[22] Filed: Mar. 9, 1998

Related U.S. Application Data

[63] Continuation of application No. 08/802,878, Feb. 19, 1997, Pat. No. 5,873,021, which is a continuation of application No. 08/672,039, Jun. 26, 1996, Pat. No. 5,697,038, which is a continuation of application No. 08/177,318, Jan. 4, 1994, Pat. No. 5,555,081.

[30] Foreign Application Priority Data

| | | | |
|---|---|---|---|
| Jan. 12, 1993 | [JP] | Japan | 5-003435 |
| Mar. 2, 1993 | [JP] | Japan | 5-041246 |
| Oct. 27, 1993 | [JP] | Japan | 5-269019 |

[51] Int. Cl.[7] ..... G03G 21/00

[52] U.S. Cl. ..... 399/356; 399/358

[58] Field of Search ..... 399/353, 356, 399/357, 358, 349, 267, 277, 282

[56] References Cited

U.S. PATENT DOCUMENTS

| | | | |
|---|---|---|---|
| 4,254,202 | 3/1981 | Matsumoto et al. . | |
| 4,426,151 | 1/1984 | Aguro et al. | 399/349 |
| 4,428,665 | 1/1984 | Hays | 399/356 |

(List continued on next page.)

FOREIGN PATENT DOCUMENTS

| | | |
|---|---|---|
| 30 05 455 A1 | 8/1981 | Germany . |
| 30 08 559 A1 | 9/1981 | Germany . |
| 39 41 506 | 6/1990 | Germany . |
| 42 23 147 | 1/1993 | Germany . |
| 44 22 635 A1 | 1/1995 | Germany . |
| 56-69676 | 6/1981 | Japan . |
| 61-185070 | 11/1986 | Japan . |
| 62-10682 | 1/1987 | Japan . |
| 62-28782 | 2/1987 | Japan . |
| 62-28783 | 2/1987 | Japan . |
| 62-269189 | 11/1987 | Japan . |
| 63-41885 | 2/1988 | Japan . |
| 63-56676 | 3/1988 | Japan . |
| 1-76074 | 3/1989 | Japan . |
| 3-256058 | 11/1991 | Japan . |

*Primary Examiner*—Susan S. Y. Lee
*Attorney, Agent, or Firm*—Oblon, Spivak, McClelland, Maier & Neustadt, P.C.

[57] ABSTRACT

A cleaning device for cleaning a photoconductive element of an electrophotographic apparatus. A cleaning mechanism is held in contact with a surface of the photoconductive element of the electrophotographic apparatus. The cleaning mechanism includes a cleaning member, for example a cleaning blade, held in contact with the surface of the photoconductive element for removing toner remaining on the surface of the photoconductive element. A rotatable magnet body is provided in close proximity to the cleaning member for causing the toner removed by the cleaning member to magnetically deposit on the rotatable magnet body. The rotatable magnet body may be further provided such that it does not contact the photoconductive element. A scraping member scraps off toner deposited on the rotatable magnetic body and a waste toner tank has an external opening through which the toner removed by the cleaning member is collected. The rotatable magnet body blocks the external opening of the waste toner tank such that the toner collected in the waste toner tank is prevented from flowing outside through the external opening of the waste toner tank. Further, each of the plurality of magnets may be magnetized in a direction parallel to a direction of movement of the photoconductive element.

8 Claims, 12 Drawing Sheets

U.S. PATENT DOCUMENTS

| | | | |
|---|---|---|---|
| 4,436,412 | 3/1984 | Yamagata et al. | 399/356 |
| 4,470,694 | 9/1984 | Murakami et al. . | |
| 4,482,244 | 11/1984 | Yamazaki et al. | 399/356 |
| 4,515,467 | 5/1985 | Suzuki | 399/356 X |
| 4,518,248 | 5/1985 | Nishikawa . | |
| 4,533,235 | 8/1985 | Uchida | 399/357 |
| 4,571,071 | 2/1986 | Bothner | 399/356 X |
| 4,618,250 | 10/1986 | Noguchi et al. | 399/357 |
| 4,885,612 | 12/1989 | Satoh et al. | 399/356 |
| 4,888,620 | 12/1989 | Fujino et al. . | |
| 4,985,734 | 1/1991 | Honda et al. . | |
| 4,987,446 | 1/1991 | Mochimaru et al. . | |
| 5,027,161 | 6/1991 | Kume et al. | 399/356 X |
| 5,126,799 | 6/1992 | Matsuura et al. . | |
| 5,204,720 | 4/1993 | Ishida et al. . | |
| 5,268,720 | 12/1993 | Saitoh et al. . | |
| 5,298,952 | 3/1994 | Kamijo et al. . | |
| 5,315,357 | 5/1994 | Kamijo et al. . | |
| 5,331,377 | 7/1994 | Matsuura et al. . | |
| 5,349,425 | 9/1994 | Kamijo et al. . | |
| 5,363,177 | 11/1994 | Nakano et al. . | |
| 5,376,997 | 12/1994 | Yamato et al. | 399/356 |
| 5,475,479 | 12/1995 | Hatakeyama et al. . | |
| 5,489,747 | 2/1996 | Takenaka et al. . | |
| 5,555,081 | 9/1996 | Hatta et al. | 399/358 |
| 5,697,038 | 12/1997 | Hatta et al. | 399/358 |
| 5,873,021 | 2/1999 | Hatta et al. | 399/358 |

CLEANING DEVICE FOR CLEANING RESIDUAL TONER FROM A PHOTOCONDUCTIVE ELEMENT

This application is a Continuation of application Ser. No. 08/802,878, filed on Feb. 19. 1997, now U.S. Pat. No. 5,873,021, which is a continuation of application Ser. No. which is a Ser. No. 08/672,039, filed on Jun. 26, 1996, now U.S. Pat. No. 5,697,038; which is a continuation of application Ser. No. 08/177,318, filed on Jan. 4, 1994, now U.S. Pat. No. 5,555,081.

BACKGROUND OF THE INVENTION

The present invention relates to a cleaning device and a developing device incorporated in a facsimile apparatus, printer or similar electrophotographic apparatus. More particularly, the present invention is concerned with a cleaner and toner magazine (abbreviated as CTM hereinafter) having a cleaning unit and a developing unit constructed integrally with each other. The cleaning unit has a cleaning blade for removing a toner left on a photoconductive element after image transfer, and a waste toner tank for collecting it while the developing unit has a fresh toner tank storing a fresh toner.

It is a common practice with an electrophotographic apparatus to form a latent image electrostatically on an image carrier e.g., photoconductive element, develops the latent image with a developer, i.e., toner to produce a corresponding toner image, and then transfer the toner image to a paper. The paper has the toner image fixed by heat and then driven out of the apparatus as a recording. The toner left on the photoconductive element after the image transfer is scraped off by a cleaning blade and then collected in a waste toner tank. A discharge lamp illuminates the cleaned surface of the photoconductive element to dissipate charges also left on the element. The current trend in the electrophotographic apparatuses art is toward user-oriented maintenance including replenishment of a fresh toner and the collection of a waste toner. For this purpose, the manipulation for maintenance should be simplified. However, a fresh toner tank and the waste toner tank have customarily been constructed separately from each other, forcing the user to replace them one by one by a troublesome procedure. Further, in the conventional apparatus, the waste toner tank has to be provided with a sensor responsive to a condition wherein the tank has been filled up with the waste toner.

To eliminate the above problems, there has been proposed a system in which the photoconductive element, developing device, fresh toner tank, cleaning device and waste toner tank are constructed into a unit: when, for example, the fresh toner tank runs out of toner, the unit is bodily replaced. This, however, increases the cost of the unit as well as the running cost per paper since, for example, the photoconductive element, developing device, cleaning device and waste toner tank which are still usable have to be discarded together with the empty fresh toner tank. Moreover, toxic substances are contained in the unit and apt to invite environmental pollution when the unit is discarded. Although the manufacture may collect and refill the fresh toner tank, even the photoconductive element, developing device, cleaning device and waste toner tank not directly contributing to toner replenishment have to be transported, resulting in an extra transport cost.

In the light of the above, there has also been proposed a CTM in which fresh toner tank and waste toner tank are constructed integrally with each other. The CTM, which is bodily replaceable, simplifies maintenance, eliminates the need for the sensor responsive to the full state of the waste toner tank, and solves the environmental pollution problem. In the conventional CTM, the fresh toner tank is fully independent of the developing device and replenishes it with a toner via a long transport path implemented by a motor, screw, guide, agitator, etc.

With an electrophotographic apparatus using such a CTM, the user is expected to perform maintenance including the replenishment of a fresh toner and the collection of a waste toner. It is, therefore, preferable that the manipulation for maintenance be simple, and the frequency of replacement of the CTM be low. To reduce the frequency of replacement, each of the fresh toner tank and waste toner tank should advantageously be provided with a great capacity. However, such bulky tanks are disadvantageous from a space saving standpoint. Further, the fresh toner tank run out of toner simply wastes the space and, in addition, degrades cost performance of the apparatus since it is made up of a number of members for effecting efficient replenishment. Moreover, since the toner is transported over a long transport path, the quality thereof and, therefore, image quality is apt to fall.

On the other hand, an electrophotographic apparatus of the type described is practicable with one or two different charging methods, i.e., a corona charging method and a contact charging method. The corona charging method, which uses a corona charger, is predominant today since it is capable of charging the photoconductive element uniformly over a long period of time. By contrast, the contact charging method holds a charger in contact with the photoconductive element. This kind of method is susceptible to the contact condition of the charger with the photoconductive element and the surface condition of the element. With the contact charging method, therefore, it is difficult to charge the photoconductive element uniformly over a long period of time. For example, it is likely that toner particles, paper dust and other impurities deposited on the photoconductive element are transferred to the charger, e.g., charge roller, lowering the charging ability of the charger due to contamination.

However, the contact charger is advantageous over the corona charger in that it produces a minimum of ozone during operation, and in that it is operable with a low voltage. The reduction of ozone, among others, meets the increasing demand for improved office environments. For this reason, the increase in the cost of equipment to be operated in offices is generally accepted. In this situation, the prerequisite is that the contact charger be replaced periodically, and that the deterioration of such a charger due to aging be slowed down.

SUMMARY OF THE INVENTION

It is, therefore, an object of the present invention to provide CTM easy to replace and handle and facilitating maintenance.

It is another object of the present invention to provide a CTM providing a fresh toner tank with a great capacity.

It is another object of the present invention to provide a CTM having a simple construction, increasing the size of a fresh toner tank, reducing the overall size, and saving space.

It is another object of the present invention to provide a CTM which can be mounted to and positioned on an electrophotographic apparatus with ease.

It is another object of the present invention to provide a CTM constructed integrally with a contact charger and slowing down the fail of the ability of the charger.

It is another object of the present invention to provide a CTM promoting stable and sure collection of a remaining toner over a long period of time.

A CTM for replenishing a developing device of an electrophotographic apparatus with a toner of the present invention comprises a waste toner tank for removing a toner left on a photoconductive element of the electrophotographic apparatus after image transfer and collecting the toner, a fresh toner tank constructed integrally with the waste toner tank for replenishing the developing device with a fresh toner, and a connecting mechanism for connecting the waste toner tank and fresh toner tank such that the fresh toner tank is movable to the developing device.

BRIEF DESCRIPTION OF THE DRAWINGS

The above and other objects, features and advantages of the present invention will become more apparent from the following detailed description taken with the accompanying drawings in which.

Figure 22:
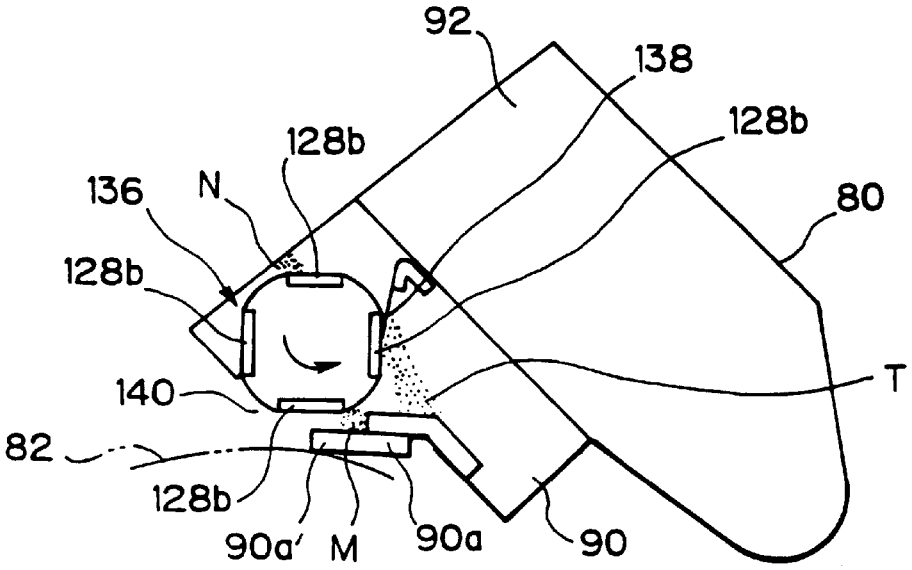

FIGS, 21A and 21B are perspective views each showing a rotary magnet body included in the eighth embodiment in a particular condition of magnetization:

FIG. 22 is a section of a modification of the eighth embodiment: and

Figure 23:
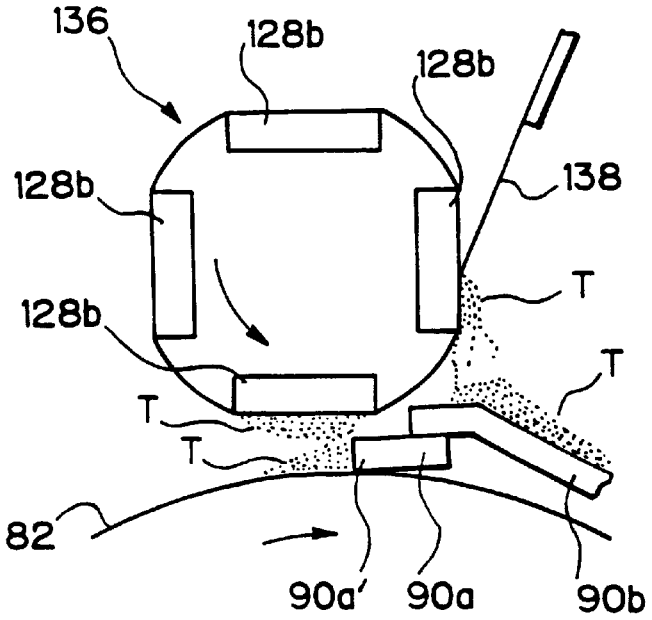

FIG. 23 is a section showing another modification of the eighth embodiment.

DESCRIPTION OF THE PREFERRED EMBODIMENTS

Preferred embodiment of the CTM in accordance with the present invention will be described hereinafter.

1st Embodiment

Figure 1:
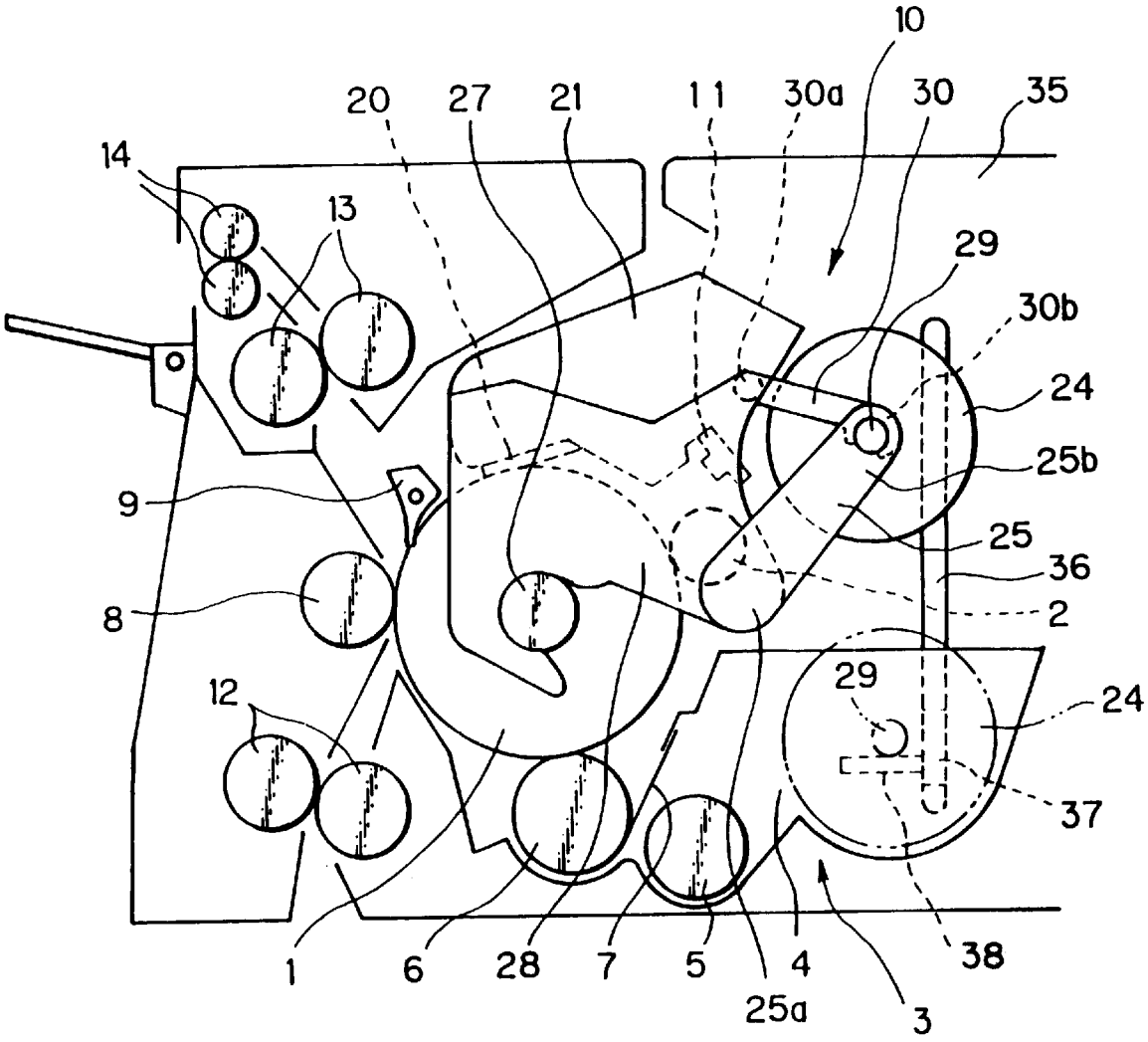
FIG. 1 is a section of an electrophotographic apparatus implemented with a first embodiment of the CTM in accordance with the present invention.

Referring to FIG. 1 of the drawings, an electrophotographic apparatus implemented with a CTM embodying the present invention is shown. As shown, the apparatus has an image carrier in the form of a photoconductive drum 1, a charge roller, or contact charger, 2, and a developing device 3 including a toner reservoir 4, a toner supply roller 5, a developing roller 6, and a blade 7. There are also shown in the figure an image transfer roller 8, a paper separator 9, a CTM 10 embodying the present invention, a discharge lamp 11, a registration roller pair 12, a fixing roller pair 13, and an outlet roller pair 14.

Figure 2:
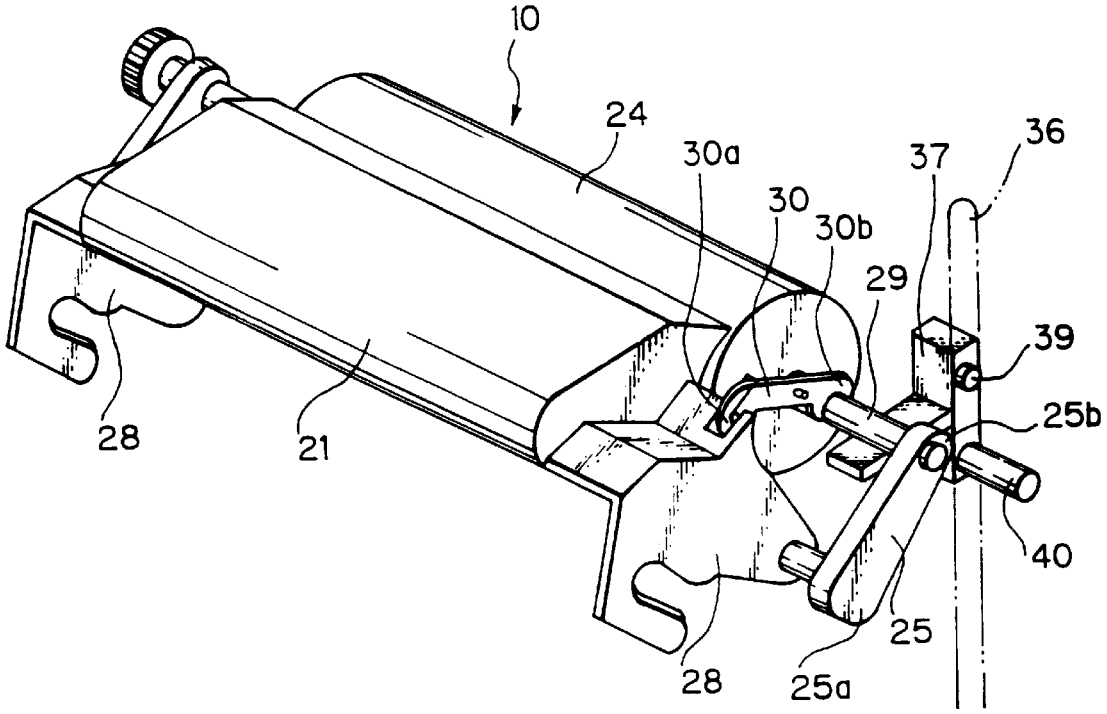
FIG. 2 is a perspective view of the CTM shown in FIG. 1.
Figure 3:
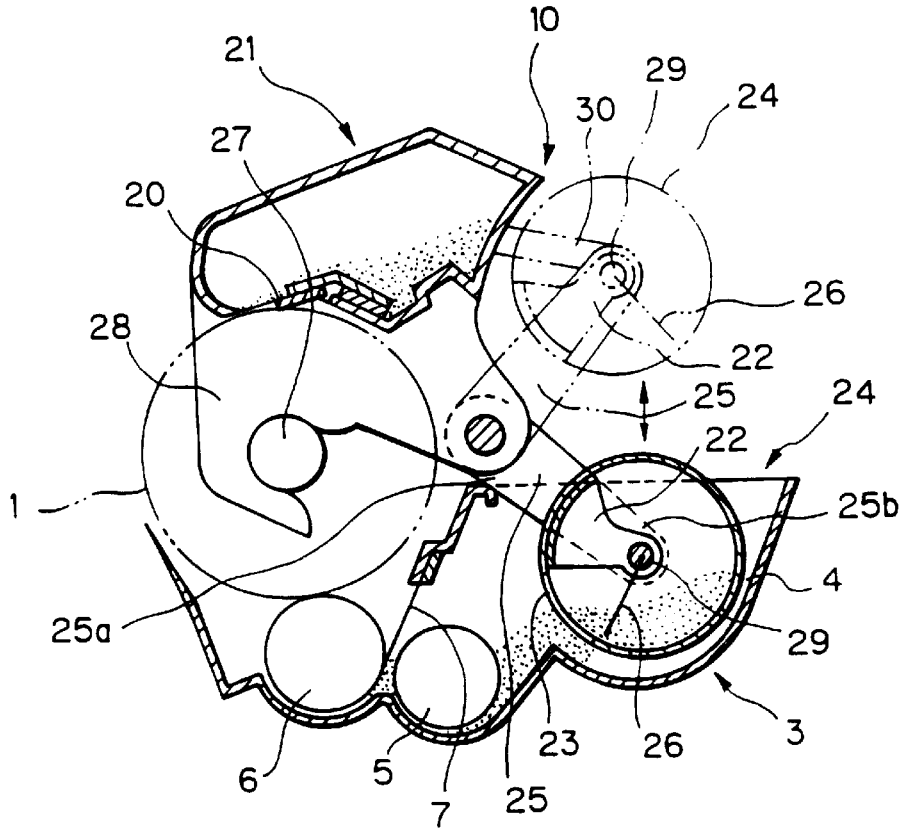
FIG. 3 is a section of the CTM shown in FIG. 1.

As shown in FIGS. 2 and 3, the CTM 10 has a waste toner tank 21 provided with a cleaning blade 20 which removes a toner remaining on the drum 1 in contact with the drum l. A fresh toner tank 24 stores a fresh toner and has an opening 23 which is selectively opened or closed by a shutter 22. An agitator 26 is disposed in the fresh toner tank 24. The waste toner tank 21 and fresh toner tank 24 are movably connected to each other by a lever 25. Specifically, a leg 28 extends out from the side wall of the waste toner tank 21 and is engaged with a rotary shaft 27 on which the drum 1 is mounted. One end 25*a* of the lever 25 is rotatably mounted on the leg 28 while the other end 25*b* is mounted on a shaft 29 which supports the fresh toner tank 24. As shown in FIG. 2, a lock arm, or retaining member, 30 is rotatably connected to the leg 28 at one end 30*a* and movable into and out of engagement with the shaft 29 at the other end 30*b*.

The electrophotographic apparatus has a body or casing 35. As shown in FIG. 2, an elongate slot 36 is formed through the casing 35 in the vertical direction. A liftable member, or returning member, 37 is movable up and down by being guided by the slot 36. The liftable member 37 has an arm 38 extending to a position where it can contact the lower portion of the shaft 29, a guide lug 39 movably received in the slot 36, and a grip 40 extending out to the outside of the casing 35.

The operation of the CTM 10 will be described hereinafter. The image forming procedure implemented by the drum 1, charge roller 2, developing device 3, transfer roller 8 and discharge lamp 11 is conventional and will not be described specifically. In the position indicated by solid lines in FIGS. 1 and 2 and a dash-and-dots line in FIG. 3, the CTM 10 has the waste toner tank 21 and fresh toner tank 24 held in an unmovable condition. The end 30*b* of the lock arm 30 is held in engagement with the shaft 29 of the fresh toner tank 24. In this condition, the CTM 10 can be removed and replaced easily. The CTM 10 may even be put on the market alone in such an unmovable condition. The CTM 10 is set in a predetermined position within the casing 35 with the leg 28 thereof engaged with the shaft 27 of the drum 1. When the lock arm 30 is rotated, it is released from the shaft 29 of the fresh toner tank 24. As a result, the tank 24 is rotated clockwise, as viewed in FIG. 3, about the end 25*a* of the lever 25 and brought into the toner reservoir 4 of the developing device 3. Subsequently, the shutter 22 is moved by drive means, not shown, to uncover the opening 23 of the tank 24. Then, the agitator 26 disposed in the tank 24 is rotated to force the fresh toner into the toner reservoir 4.

In the waste toner tank 21, the cleaning blade 20 scrapes off the toner left on the drum 1 after image transfer, as conventional. The toner removed from the drum 1 is collected in the tank 21.

Assume that the fresh toner tank 24 has run out of toner, requiring the user to replace the CTM 10 with a new CTM. Then, the grip 40 protruding from the liftable body 37 to the outside of the casing 35 is lifted along the slot 36 manually. Consequently, the arm 38 of the body 37 is brought into contact with the lower portion of the shaft 29 of the fresh toner tank 24, causing the tank 24 to return to the position where it adjoins the waste toner tank 21. As a result, the lock arm 30 is again engaged with the shaft 29 to prevent the two tanks 21 and 24 from moving. In this condition, the CTM 10 can be bodily removed and replaced with ease.

As stated above, the fresh toner tank 24 replenishes the fresh toner while being received in the toner reservoir 4 of the developing device 3. The tank 24, therefore, plays the role of a conventional toner hopper at the same time. This eliminates the need for a motor, screw and guide otherwise incorporated to convey the toner and, therefore, simplifies construction, reduces size, and saves space. In addition the CTM 10 is easy to replace since the waste toner tank 21 and fresh toner tank 24 are joined with each other before the replacement.

2nd Embodiment

Figure 4:
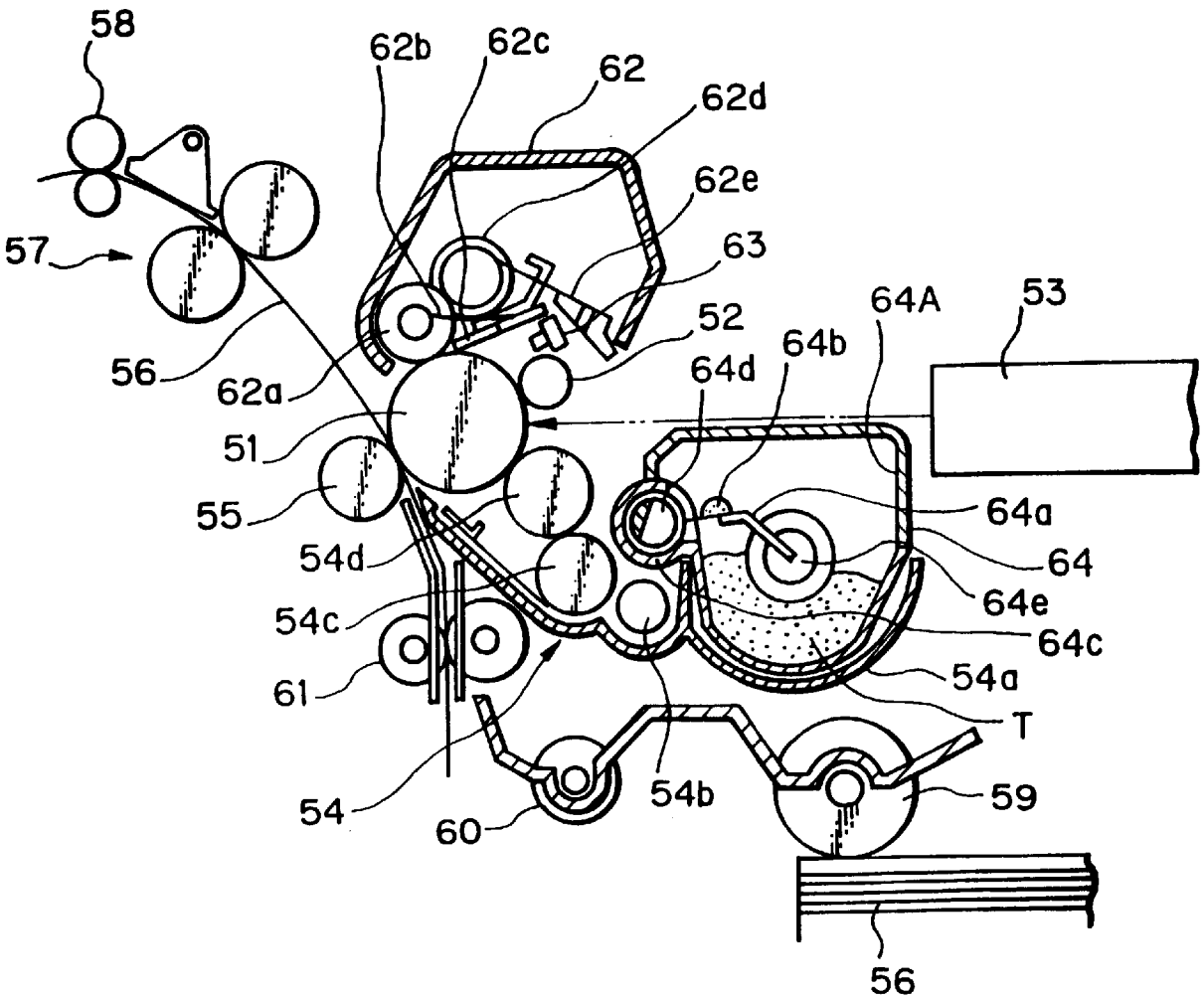
FIG. 4 is a section showing an electrophotographic apparatus incorporating a second embodiment of the present invention.

FIG. 4 shows an electrophotographic apparatus incorporating an alternative embodiment of the present invention. As shown, the apparatus has a photoconductive drum 51 made up of a metallic core and a photoconductive layer formed on the core. A charge roller, or contact charger, 52 uniformly charges the surface of the drum 51 during image forming operation. Optics 53 exposes the surface of the drum 51 imagewise to form a latent image thereon electrostatically. A fresh toner tank 64 and a waste toner tank 62 constitute a CTM as will be described. A developing device 54 develops the toner image formed on the drum 1 by depositing a toner thereon. A transfer roller 55 transfers the resulting toner image from the drum 1 to a paper 56. A fixing roller 57 fixes the toner image on the paper 56 by pressure and heat. An outlet roller 58 drives the paper 56 carrying the toner image thereon out of the apparatus. A pick-up roller 59 picks up the paper 56 and feeds it toward a registration roller 61 via a convex or roller 60. The registration roller 61 drives the paper 56 toward the transfer roller 55 at a predetermined timing. The developing unit 54 has a hopper 54*a* on which the fresh toner tank 64 is mounted, a toner supply roller 54*b*, a developing roller 54*c* on which the fresh toner from the supply roller 54*b* is deposited in a layer, and a transfer roller 54*d* held in contact with the oiler 54*c*. The toner is transferred from the roller 54*c* to the roller 54*d* and then to the drum 51.

As shown in the figure, the waste toner tank 62, forming part of the CTM, has thereinside a brush roller 62*a* for collection the toner remaining on the drum 51 after image transfer, a flicker 62*b* held in contact with the brush roller 62*a*, a cleaning blade 62*c* held in contact with the drum 51 for scraping off the toner from the drum 51, a magnet roller 62*d* rotatable while attracting the toner removed from the drum 51, a scraper 62*e* held in contact with the magnet roller 62*d*. The reference numeral 63 designates a discharge lamp for dissipating charges left on the surface of the drum 51 after image transfer, thereby restoring it to the initial condition.

Figure 5:
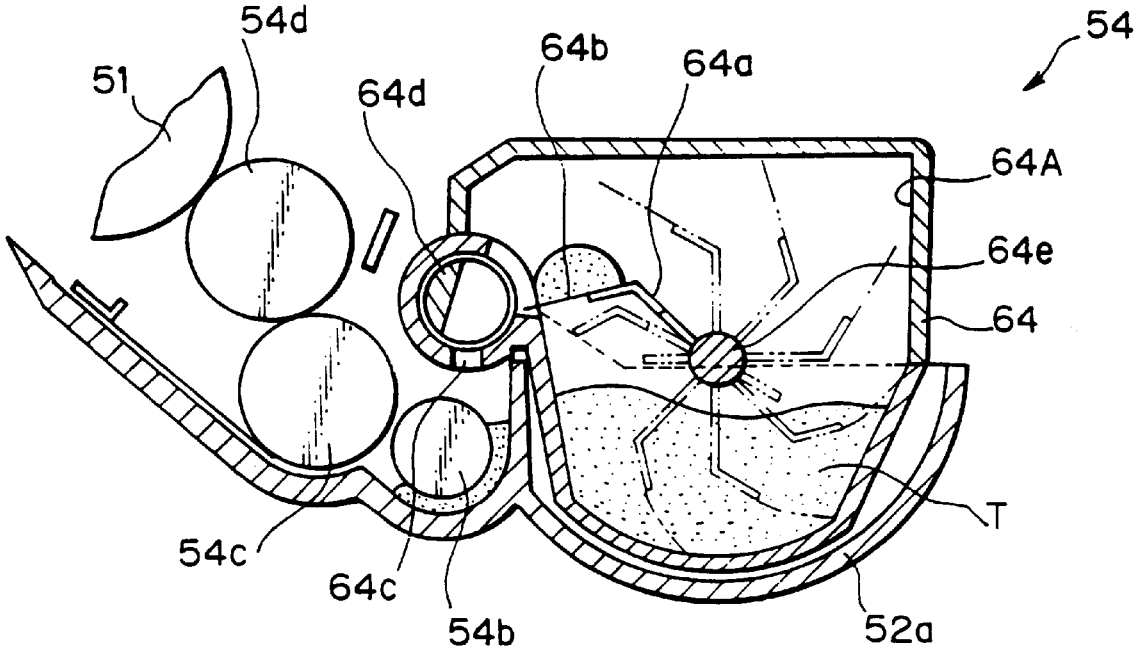
FIG. 5 is a section of a developing device included in the apparatus of FIG. 4.

As shown in FIG. 5, the fresh toner tank 64 stores a toner T and accommodates an agitator 64*a*. The agitator 64*a* is rotatable about a shaft 64*e* to agitate the toner T and provided with an elastic member 64*b* on the free end thereof. The agitator 64*a* and elastic member 64*b* constitute a conveying mechanism in combination. The elastic member 64*a* is rotatable to scrape off the toner deposited on the inner periphery 64A of the tank 64. At the same time, this member 64*a* scoops up the fresh toner T and feeds it into an outlet opening 64*c* formed in a part of the tank 64. A shutter 64*d* selectively opens or closes the outlet opening 64*c* in interlocked relation to the tank 64 which is removable from the apparatus.

Figure 6:
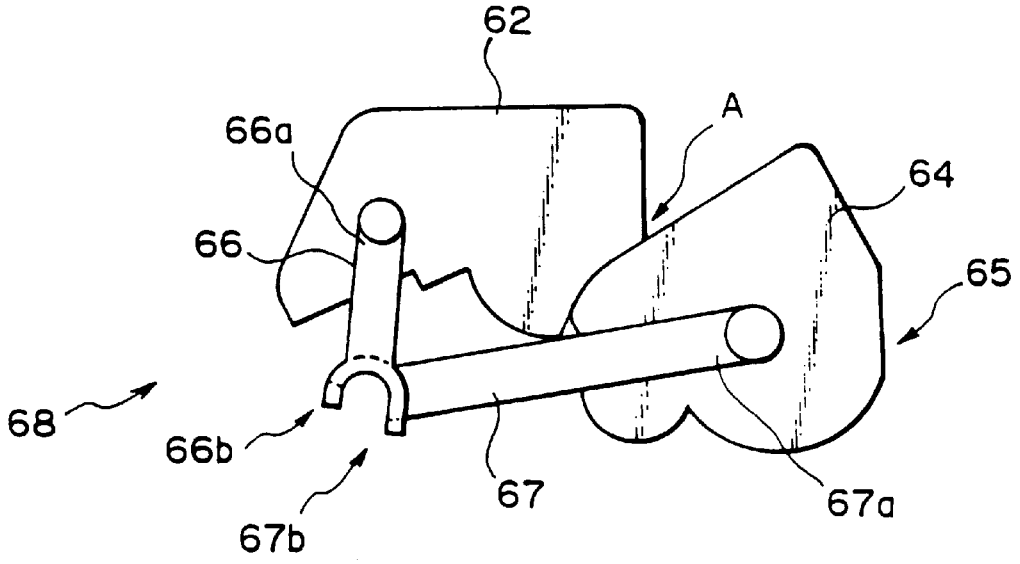
FIG. 6 is a fragmentary section of the second embodiment.

As shown in FIG. 6, the waste toner tank 62 and fresh toner tank 64 are linked to each other by a connecting mechanism 68 to constitute a single unit, i.e., CTM 65. As shown, the connecting mechanism 68 has a first arm 66 and a second arm 67. The first arm 66 is mounted on the waste toner tank 62 at one end 66*a* and bifurcated at the other end 66*b*. The second arm 67 is mounted on the fresh toner tank 64 at one end 67*a* and bifurcated at the other end 67*b*. The two tanks 62 and 64 are joined together by a seal member or similar connecting member, not shown, in the event of packing, such that their contact portions A meet each other.

Figure 7:
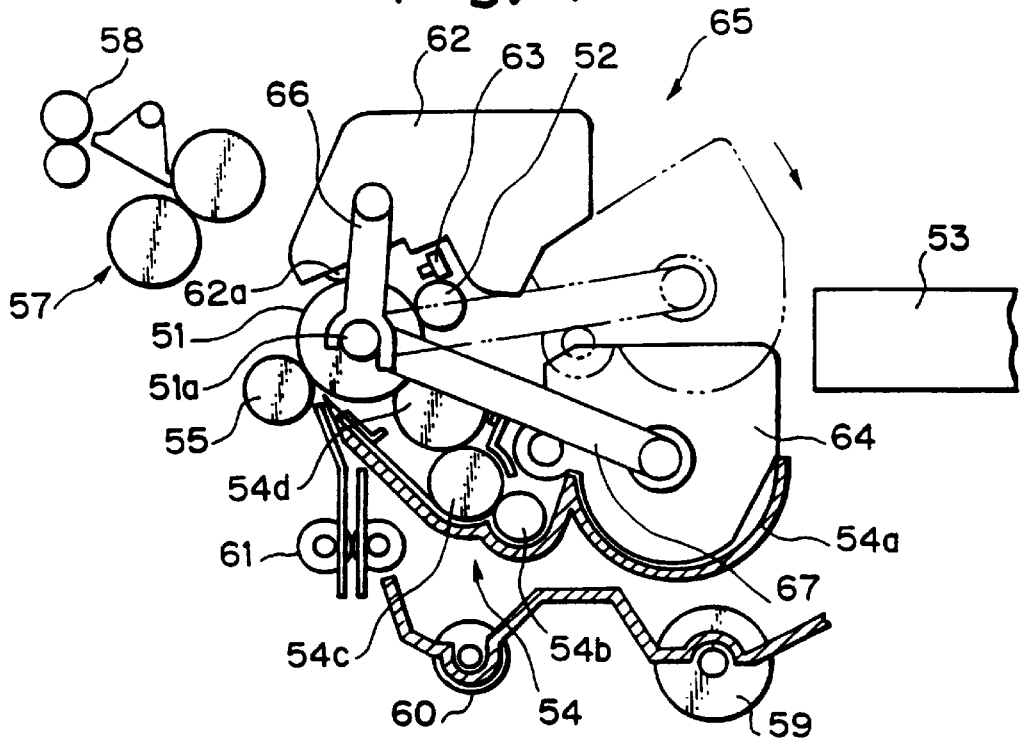
FIG. 7 is a section demonstrating the operation of a third embodiment of the present invention.

As shown in FIG. 7, the CTM 65 is mounted to the apparatus body such that the brush roller 62*a* and cleaning blade 62*c*. FIG. 4, contact the drum 51 at a position preceding the position where the discharge lamp 63 illuminates the drum 51. At this instant, the bifurcated ends 66*b* and 67*b* of the arms 66 and 67, respectively, are engaged with the shaft 5l*a* on which the drum 51 is mounted. After the connecting member has been removed from the CTM 65, the CTM 65 is inserted into the apparatus body. As the fresh toner tank 64 is mounted to the hopper 54*a*, the shutter 64*d* is opened while, at the same time, the shaft 64*e* of the agitator 64*a* is connected to a drive gear or similar drive source, not shown. During image formation, the agitator 64*a* is rotated to scoop up the fresh toner T with the free end and elastic member 64*b* thereof. This part of toner is brought to the outlet opening 64*c*. The toner T from the opening 64*c* is deposited on the supply roller 54*b* and conveyed by the roller 54*b* to the developing roller 54*c*. Subsequently, the toner T is transferred from the roller 54*c* to the transfer roller 54*d* and then to the drum 51, thereby developing a latent image formed on the drum 51. The resulting toner image is transferred from the drum 51 to a paper.

In a modification of the illustrative embodiment, the two tanks 62 and 64 are not connected by the connecting mechanism 68 and are inserted into the apparatus body in a separated state, as shown in FIG. 4.

As stated above, in the embodiment and modification thereof, the waste toner tank 62 and fresh toner tank 64 of the CTM 65 are separable from each other. Further, since the tank 64 is mounted to the hopper 54*a* by being rotated, it occupies a minimum of space. Consequently, the tank 64 can be provided with a great volume, and the overall size of the apparatus can be reduced.

3rd Embodiment

Figure 8:
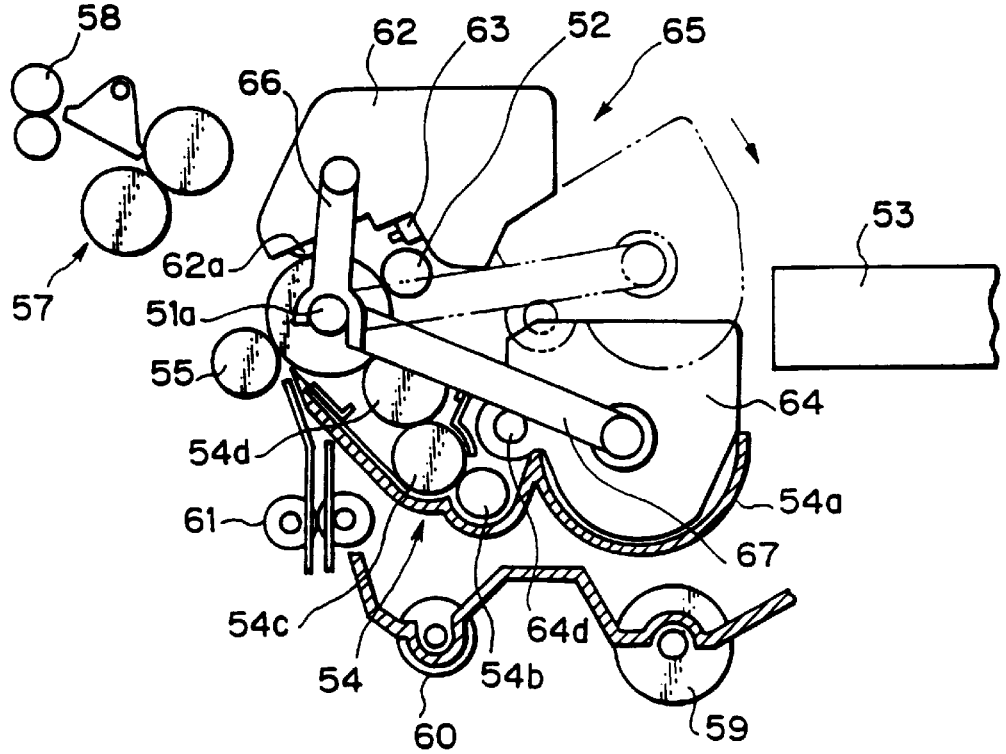
FIG. 8 is a section of an electrophotographic apparatus implemented with the third embodiment.

Another alternative embodiment of the present invention is shown in FIG. 8. As shown, the CTM 65 is similar to the CTM 65 of FIG. 7 except that the discharge lamp 63 is mounted on the waste toner tank 62. Hence, the discharge lamp 63 is removable from the apparatus body together with the CTM 65.

4th Embodiment

Figure 9:
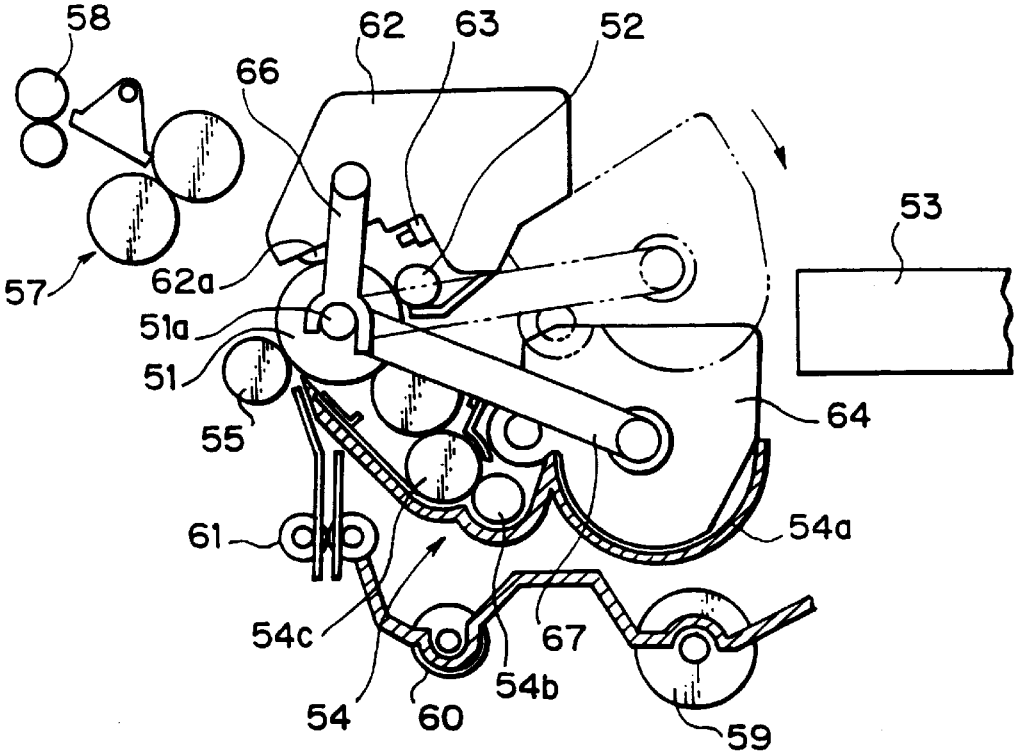
FIG. 9 is a section of an electrophotographic apparatus incorporating a fourth embodiment of the present invention.

FIG. 9 shows another alternative embodiment of the present invention. As shown, the CTM 65 is similar to the CTM 65 of FIG. 8 except that the charge roller 52 is mounted on the waste toner tank 62. This allows the discharge lamp 65 and charge roller to be removed from the apparatus body together with the waste toner tank 62.

5th Embodiment

Figure 10:
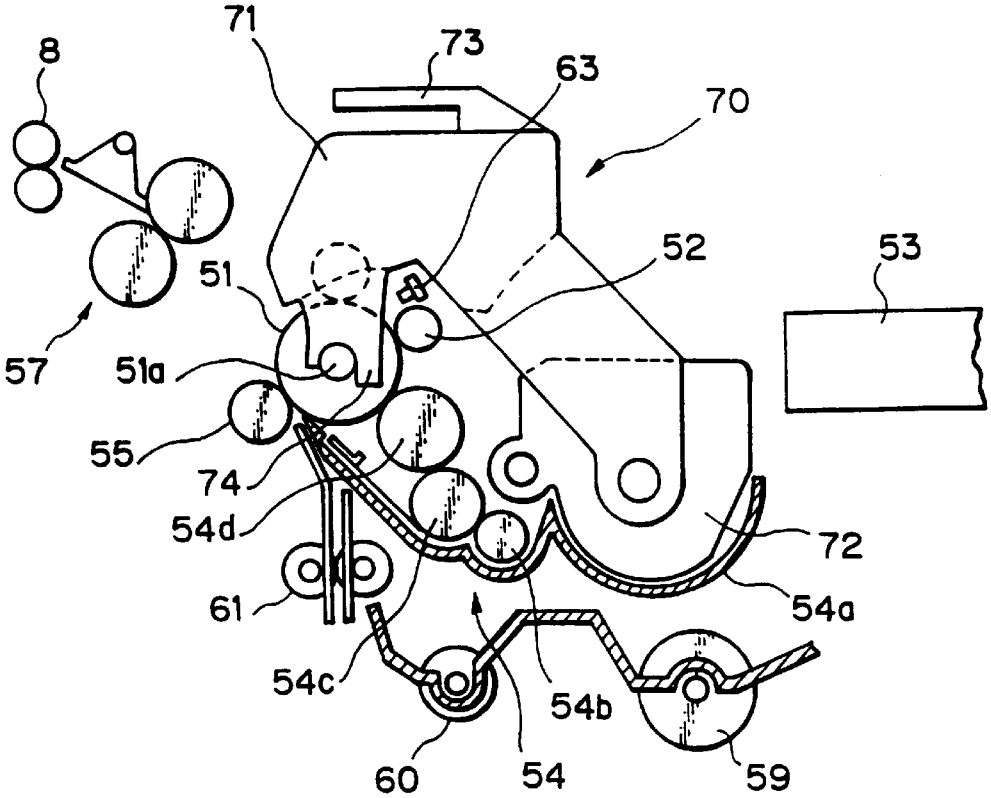
FIG. 10 is a section of an electrophotographic apparatus implemented with a fifth embodiment of the present invention.

Referring to FIG. 10, another alternative embodiment of the present invention will be described. Since this embodiment is essentially similar to the second embodiment of FIGS. 4 and 5, the same constituent parts as the parts of the second embodiment are designated by the same reference numerals. As shown, the CTM, generally 70, is made up of a waste toner tank 71 and a fresh toner tank 72. The waste toner tank 71 is provided with a grip 73 and a bifurcated engaging portion 71 which is engageable with the shaft 51*a* of the drum 51. To mount the CTM 70 to the apparatus body, the operator holds the grip 73, brings engaging portions 74 into engagement with the shaft 51*a*, and positions the fresh toner tank 72 on the hopper 54*a* of the developing unit 54. At the same time as the CTM 70 is mounted to the apparatus body, various constituents disposed in the waste toner tank 71 are each brought to a particular position relative to the drum 51. In the case where the discharge lamp 63 and/or the charge roller 52 are mounted on the CTM 70 as in the previous embodiments, they will also be located in predetermined positions relative to the drum 51.

Figure 11:
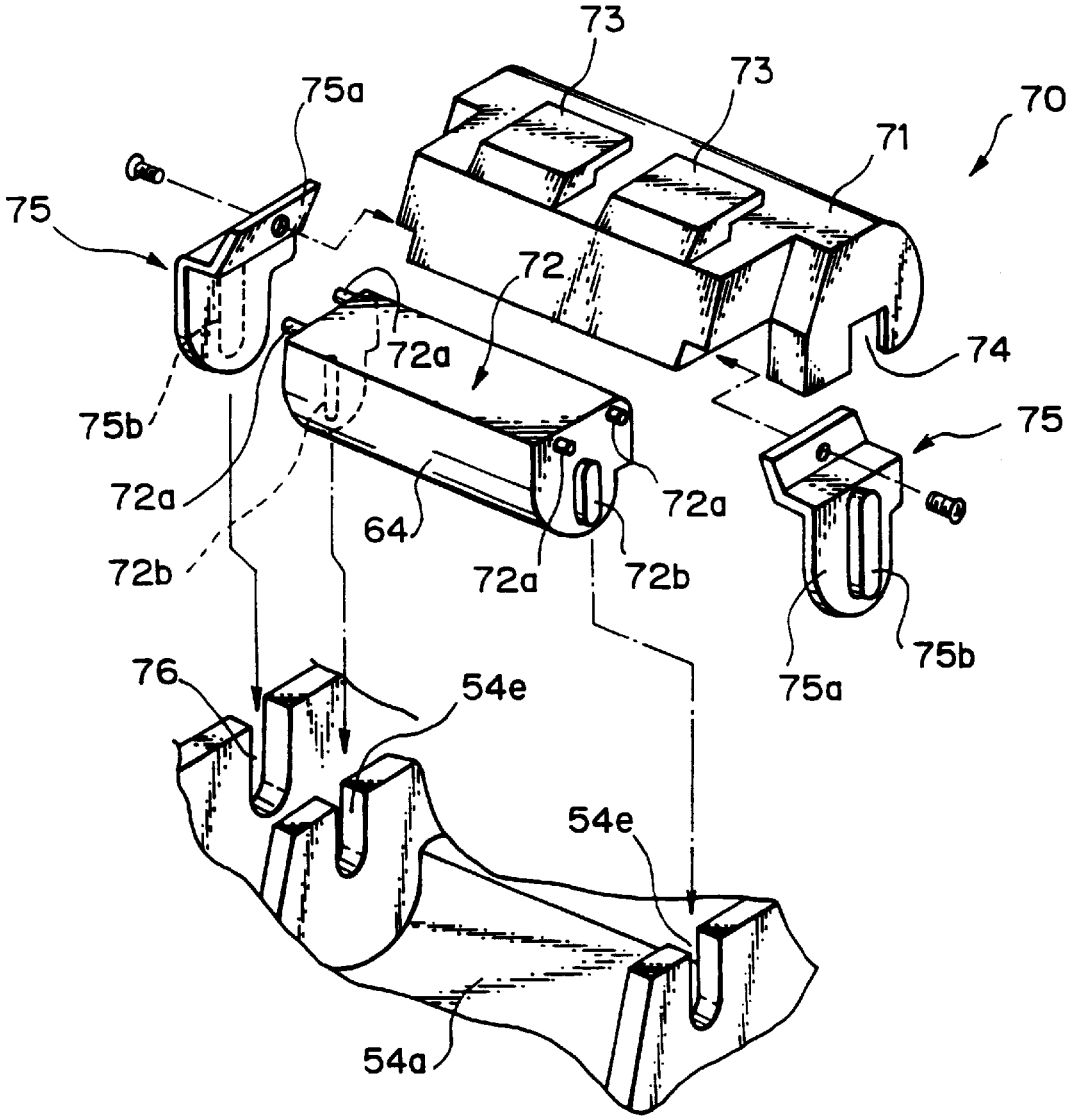
FIG. 11 is an exploded perspective view of the embodiment shown in FIG. 10.
Figure 12:
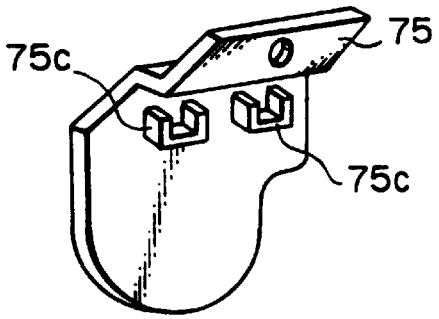
FIG. 12 is a perspective view of a connecting member shown in FIG. 11.
Figure 13:
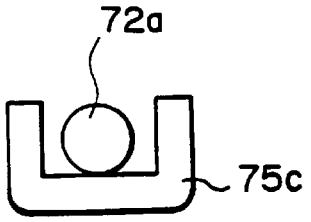
FIG. 13 is a plan view showing a seat and a boss included in the connecting member of FIG. 12 and resting on the seat.

As shown in FIG. 11 in an exploded view, the CTM 70 has connecting members 75 connecting the waste toner tank 71 and fresh toner tank 72. Each connecting member 75 is implemented as a stepped plate 75*a*. A relatively long projection or guide 75*b* is formed on the outer surface of each stepped plate 75*a* and extends in the direction for mounting the CTM 70 to the apparatus body. As shown in FIGS. 12 and 13, seats 75*c* for receiving bosses, which will be described, are formed on the inner surface of each plate 75*a*.

As shown in FIG. 11, the fresh toner tank 72 is provided with two bosses 72*a* in an upper portion of each end thereof, and a relatively long projection or guide 72*b* at substantially the center of each end. The connecting members 75 are affixed to the tank 71 with the seats 75*c* thereof each supporting the respective boss 72*a*, thereby completing the CTM 70. As shown in FIG. 13, the fresh toner tank 72 is held integrally with the waste toner tank 71 with some play. The hopper 54*a* is formed with groove-like guide rails 54*e* at opposite sides thereof for guiding the guides 72*b* of the tank 72. A groove-like guide rail 76 is formed in the apparatus body outside of each guide rail 54*e* in order to guide the respective guide 75*b* of the connecting member 75.

To mount the CTM 70 to the apparatus body, the guides 75*b* are slowly inserted into the guide rails 76 while being guided by the latter. At the same time, the guides 72*b* are inserted into the guide rails 54*e*. As soon as the engaging portions 74 are brought into engagement with the shaft 51*a*, the fresh toner tank 72 is positioned in the hopper 54*a*. The tank 72 has some play, as mentioned above, and can be positioned in the hopper 54*a* even if the guide rails 54*e* have some dimensional error.

As stated above, the guides 75*b* and 72*b* provided on the CTM 70 and the corresponding guide rails 76 and 54*e* allow the CTM 70 to be positioned accurately relative to the drum 51 and developing unit 54. In addition, the grip 73 promotes easy handling of the CTM 70.

6th Embodiment

Figure 14:
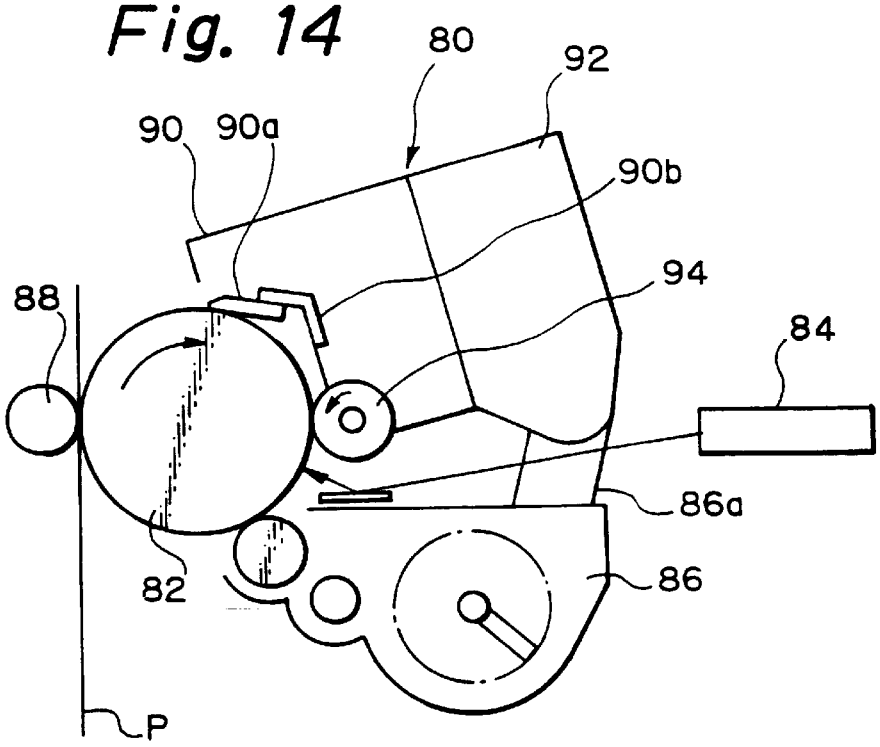
FIG. 14 is a section of an electrophotographic apparatus incorporating a sixth embodiment of the present invention.

FIG. 14 shows an electrophotographic apparatus implemented with another alternative embodiment of the present invention. As shown, the apparatus has a photoconductive drum 82, a laser unit 84 for scanning the drum 82 with a laser beam, a developing device 86, a transfer roller 88, and a CTM 80. The CTM 80 has a waste toner tank 90 and a fresh toner tank 92 constructed integrally with each other. A cleaning blade 90*a* and a blade holder 90*b* are disposed in the waste toner tank 90. When the CTM 80 is mounted to the apparatus body, as shown in the figure, a charge roller 94 contacts the surface of the drum 82. A mechanism, which will be described, causes the charge roller 94 to rotate in association with and at the same linear velocity as the drum 82. When a charge voltage is applied to the roller 94, the roller 94 charges the surface of the drum 82 uniformly to a predetermined polarity. The laser unit 84 scans the charged surface of the drum 82 with a laser beam to form an electrostatic latent image thereon. The developing device 86 develops the latent image with a toner to form a corresponding toner image. As a paper P is transported to an image forming region where the transfer roller 88 is located, the roller 88 transfers the toner image from the drum 82 to the paper P while nipping it in cooperation with the drum 82. After the image transfer, the cleaning blade 90*a* removes the toner remaining on the drum 82 and collects it in the waste toner tank 90. The fresh toner tank 92 replenishes the developing device 86 with a fresh toner via a duct 86*a* such that the amount of toner in the device 86 remains constant. When the waste toner tank 90 is filled with the collected toner or when the fresh toner tank 92 runs out of toner, a message for urging the user to replace the CTM 80 is displayed. The user, therefore, can replace the CTM 80 periodically.

Figure 15:
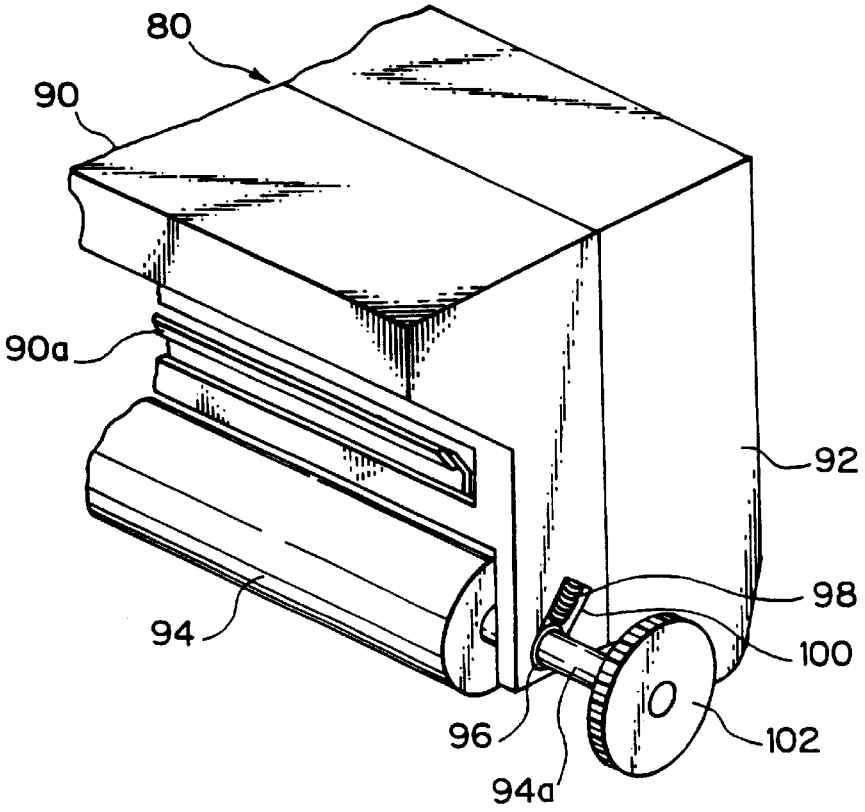
FIG. 15 is a perspective view of the embodiment shown in FIG. 14.
Figure 16:
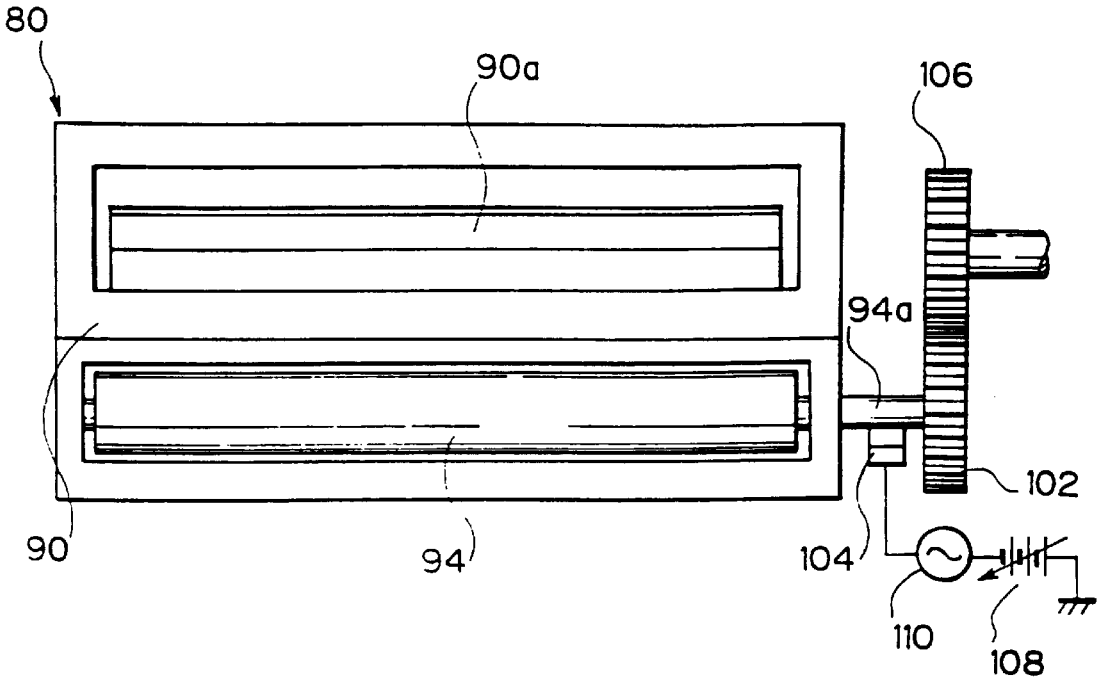
FIG. 16 is a plan view of the embodiment of FIG. 14 mounted to the electrophotographic apparatus.
Figure 17:
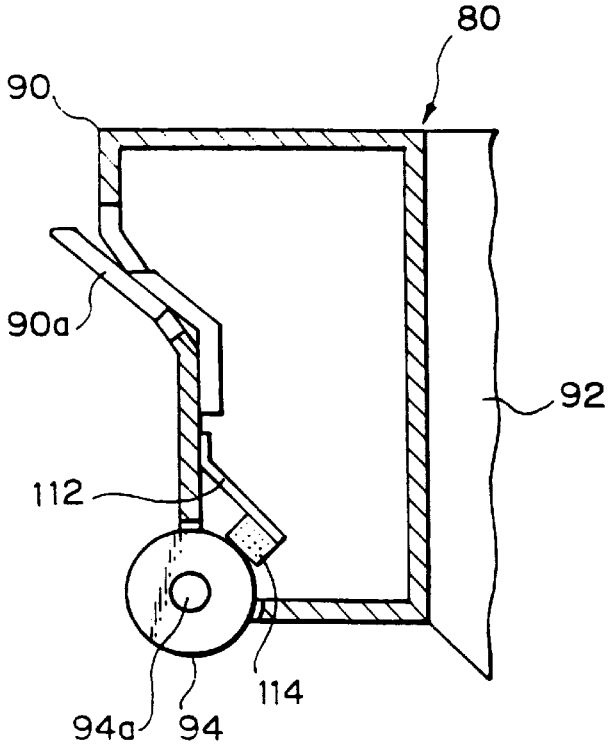
FIG. 17 is a section of a cleaning device included in the embodiment of FIG. 14 and disposed in a waste toner tank.

FIGS. 15 and 16 show the CTM 80 more specifically. As shown, the waste toner tank 90 is formed with an elongate slot 100 in each of opposite ends thereof. The charge roller 94 is mounted on a rotary shaft 94 a which is made of a conductive material and rotatably supported by bearings 96. The bearings 96 are each received in the respective slot 100 of the tank 90 together with a spring 98 and constantly biased toward one end of the slot 100 by the spring 98. A drive gear 102 is affixed to one end of the shaft 94*a*.

As shown in FIG. 16, when the CTM 80 is mounted to the apparatus, a brush 104 contacts the periphery of the shaft 94*a*. At the same time, the drive gear 102 is brought into mesh with a gear 106 which is connected to a drive motor, not shown. Connected to the brush 104 are a DC power source 108 for generating a DC voltage in association with the drive motor, and a DC/AC converter 110 for converting the DC voltage to an AC charge voltage. In the position shown in the figure, the charge roller 94 is urged against the drum 82 by the springs 98.

During the course of image formation, the charge roller is rotated at the same linear velocity as the drum 82 by the motor via the gears 106 and 102. As a result, the surface of the drum 82 is uniformly charged and prepared for the formation of a latent image using a laser beam.

FIG. 7 shows a device for cleaning the waste toner tank 90 of the illustrative embodiment. As shown, the cleaning device has a stay 112 fixed in place in the tank 90, and a cleaning member 114 fitted on the free end of the stay 112. The cleaning member 114 may be constituted by felt and silicone oil applied thereto. Generally, it is likely that the toner left on the drum 82 after image transfer, paper dust and other impurities are transferred to the charge roller 94, and that the toner scattered around in the apparatus deposits on the charge roller 94. Such deposits on the roller 94, even if a little, prevent the roller 94 from contacting the drum 82 stably. Then, the roller 94 fails to charge the drum 82 uniformly. The cleaning member 114 in rotation slides on the surface of the roller 94 to remove such deposits from the roller 94 and collects them in the tank 90. This is successful in preserving the charging ability of the roller 94 over a long period of time and preventing the interior of the apparatus from being contaminated.

In this embodiment, the charge roller 94 is replaced together with the CTM 80, i.e., the roller 94 whose charging ability lowers due to aging is replaced periodically. Hence, the roller 94 is maintained in a desirable state at all times. It allows that the drum 82 can be uniformly charged by a contact charger which produces a minimum of ozone.

7th Embodiment

Figure 18:
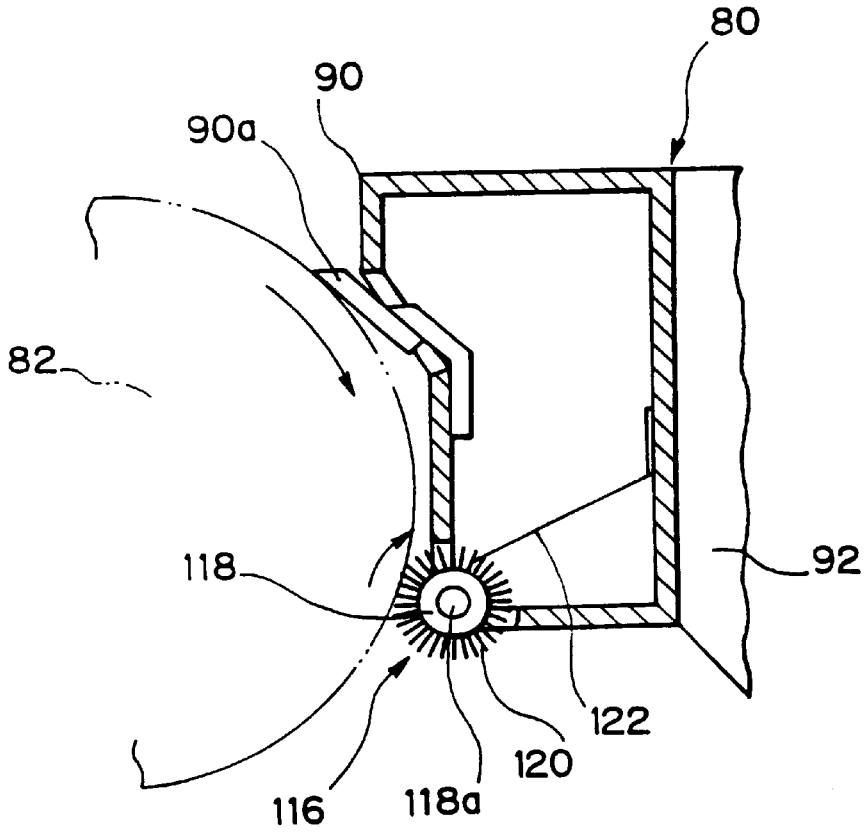
FIG. 18 is a section showing a seventh embodiment of the present invention.

FIG. 18 shows another alternative embodiment of the present invention. As shown, the waste toner tank 90 of the CTM 80 is similar to the tank 90 of the sixth embodiment except that a charge brush 116 is substituted for the charge roller 94. The charge brush 116 has a roller portion 118 and a brush portion 120 implanted in the roller portion 118. Assume that the CTM 80 is mounted to the apparatus body, and an image forming operation is effected. Then, a shaft 118*a*, on which the roller portion 118 is mounted, is driven by a drive motor, not shown, with the result that the roller portion 118 is rotated in the same direction as the, drum 82. Further, a charge voltage is applied from the apparatus body to the brush portion 120 via the roller portion 118. In this condition, the outer periphery of the brush portion 120 charges the surface of the drum 82 uniformly while sliding thereon. The tank 90 is provided with a cleaning device, as in the sixth embodiment. The cleaning device is implemented by a thin elastic cleaning sheet 112 which is held in contact with the brush portion 120 at the free end thereof. While the charge brush 116 is in rotation the cleaning sheet 122 causes the brush portion 120 to elastically deform and vibrate, thereby causing the deposits to fall from the brush portion 120. The deposits so removed from the brush 120 are collected in the tank 90. Again, this is successful in preserving the charging ability of the charge brush 116 for a long time and preventing the interior of the apparatus from being contaminated.

In this embodiment, the charge brush 116 is replaced together with the CTM 80, i.e., the brush 116 whose charging ability lowers due to aging is replaced periodically. Hence, the roller brush 116 is maintained in a desirable state at all times. It follows that the drum 82 can be uniformly charged by a contact charger which produces a minimum of ozone.

8th Embodiment

Figure 19:
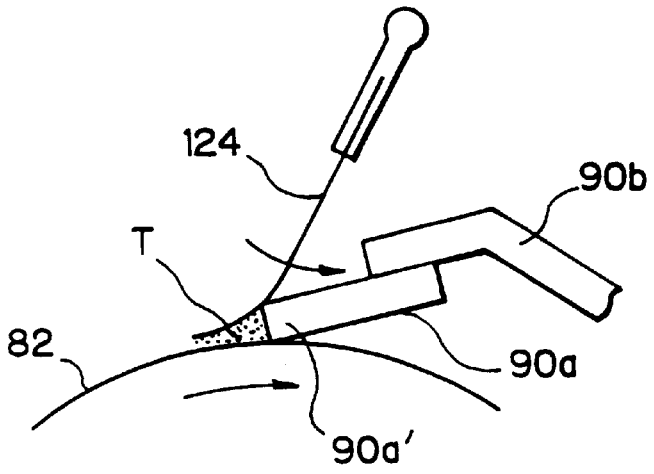
Fig. 19 PRIOR ART
FIG. 19 is a fragmentary section of a conventional CTM.
Figure 20:
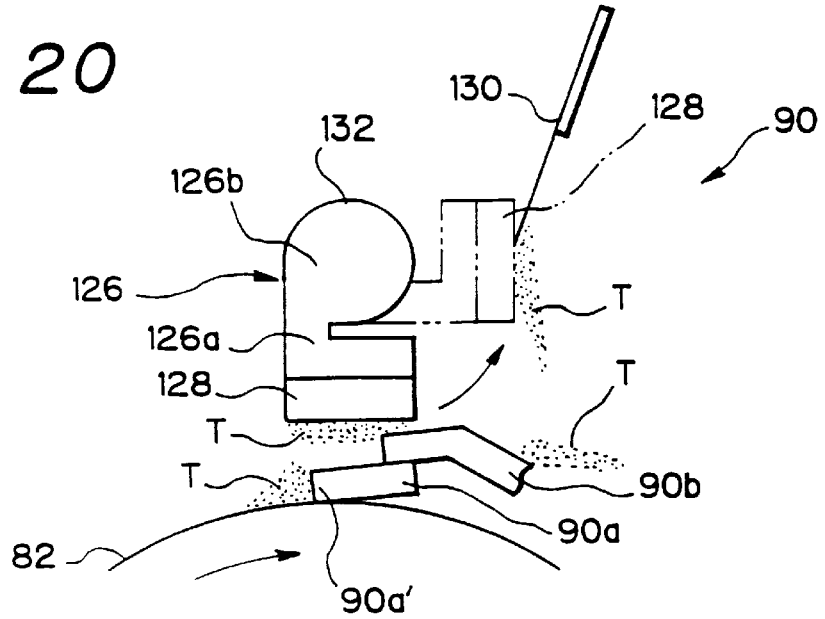
FIG. 20 is a section of a waste toner tank representative of an eighth embodiment of the present invention.

Another alternative embodiment of the present invention to be described is similar to the embodiment FIG. 14, but it allows the cleaning blade 90*a* of the waste toner tank 90 to effect more efficient cleaning. As shown in FIG. 19, there has been proposed an arrangement wherein the cleaning blade 90*a* removes the toner T left on the drum 82 after image transfer with the edge 90'*a* thereof, while a rotatable brush 124 scrapes it off into the tank 90. This kind of arrangement can collect the toner into the tank 90 more efficiently than the traditional arrangement wherein the blade 90*a* simply removes the remaining toner from the drum 82. However, the prerequisite for the brush 124 to scrape the toner into the tank 9O is that it be bent to some degree beforehand. In the initial stage of operation, such a bent form of the brush 124 does not matter at all. However, the problem is that the since the tank 90 is usually located in the vicinity of a fixing section, not shown, the brush 124 is apt to deform due to, among others, thermal stresses, resulting in the decrease in toner collecting ability. This embodiment is constructed and arranged to eliminate this problem.

As shown in FIG. 2O, the waste toner tank 90 of this embodiment is provided with a holder 126 made up of an arm 126*a* and a rotatable portion 126*b* contiguous with the arm 126*a*. The holder 126 is located in close proximity to the cleaning blade 90*a* which removes the toner T from the drum 82 in contact with the drum 82. A magnet 128 is affixed to the arm 126*a* of the holder 126 by a two-sided adhesive tape or hot melt adhesion by way of example. A scraper 130 is located in the range of rotation of the magnet 128 so as to scrape off the toner T from the magnet 128. The holder 126 and magnet 128 constitute a rotatable magnet body 132. In operation, when the magnet body 132 is rotated counterclockwise, as viewed in the figure, about the rotatable portion 126*b* of the holder 126, the toner T removed by the cleaning blade 90*a* from the drum 82 is magnetically attracted by and deposited on the magnet 128. As the holder 126 is further rotated, the scraper 130 scrapes off the toner T from the magnet 128 into the tank 90.

Figure 21A:
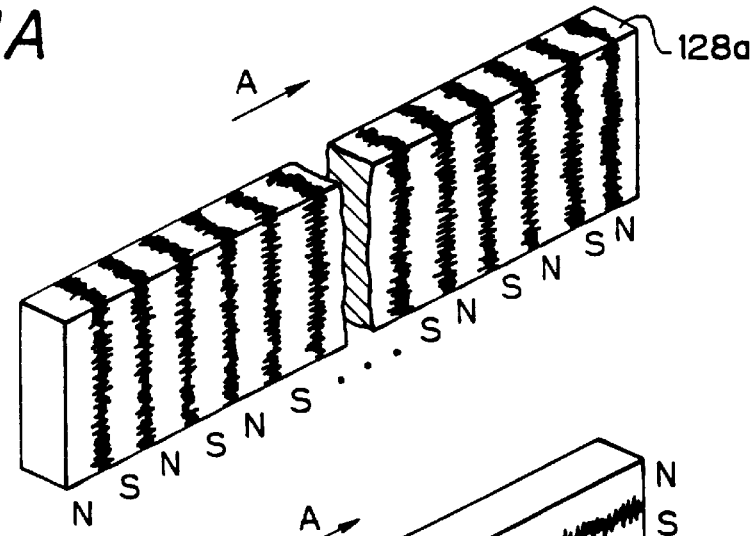
Figure 21B:
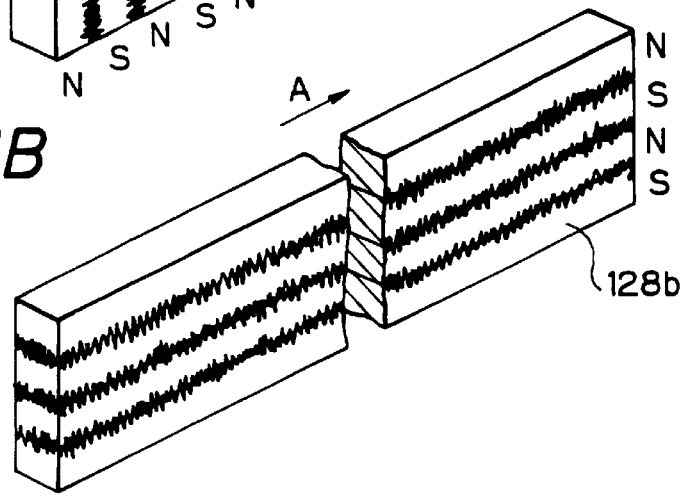

FIGS. 21A and 21B each shows a particular manner of deposition of the toner T on the magnet 128 which depends on the direction of magnetization. Specifically, FIG. 21A shows a magnet 128*a* magnetized in the direction perpendicular to the main scanning direction (arrow A) of the drum 82, while FIG. 21B shows a magnet 128*b* magnetized in the direction parallel to the direction A. The toner T is deposited on the polar portions of the magnets 128*a* and 128*b*, depending on the polarity. Hence, the magnet 128*b* of FIG. 21B can attract the toner T uniformly in the main scanning direction A. The magnet 128*a* of FIG. 21A cannot attract the toner T in the direction A in the same manner as the magnet 128*b* unless it is capable of exerting a great magnetic force.

FIGS. 22 and 23 show a modification of the eighth embodiment. As shown, the waste toner tank 90 is also provided with the cleaning blade 90*a* held in contact with the drum 82 at the edge 90*a*' thereof for removing the toner T, and the holder 90*b*. A cylindrical rotatable magnet body 136 is located in close proximity to the blade 90*a* and provided with a plurality of (four in the modification) magnets 128*b* each being magnetized as shown in FIG. 21B. The scraper 138 is located in the range of rotation of the magnet body 136, as in the eighth embodiment. It will be seen that the modification has a greater number of magnets and can, therefore, attract a greater amount of toner than the eighth embodiment for a single rotation of the magnet body.

In the eighth embodiment and modification thereof, assume that the amount of toner left on the drum 82 for a unit time is $w_a$ (g/sec), that the rotation speed of the magnet body 132 or 136 is n (r.p.m.), and that the the amount of toner to deposit on the magnet body 132 or 136 is $w_b$ (g). Then, since the ability to remove the remaining toner should exceed the amount of remaining toner to occur, the following relation has to be satisfied:

$$\frac{n}{60} \cdot w_b > w_a$$

Therefore.

$$n > 60 \cdot \frac{w_a}{w_b}$$

The amount $w_a$ of remaining toner increases with the increase in the linear velocity of the drum 82. In the light of this, the lower limit of the rotation speed n of the magnet body 132 or 136 may be increased. Specifically, a motor for driving the magnet body 132 or 136 may be rotated at a higher speed, or the gear ratio of the gearing may be changed. This kind of approach, however, would increase the cost or require a different layout. In the illustrative embodiment, the number of magnets on the magnet body 132 or 136 may be increased to increase the amount of toner deposition to twice, three times or even more, thereby lowering the lower limit of the rotation speed n. Further, when the linear velocity of the drum 82 is low, the number of magnets may be reduced. The gist is that the number of magnets of the magnet body 132 or 136 be changed in matching relation to the linear velocity of the drum 82.

Moreover, as shown in FIG. 2, the magnet body 136 blocks an opening 140 formed through the tank 90. When the body 136 is brought to a stop, the magnets 128*b* are located in the vicinity of a paths N and M along which the toner T flows to the outside. In this configuration, the toner T forming columns on the magnets 128*b* obstructs the paths N and M so as to prevent the toner T collected in the tank 90 from flowing out.

In summary, it will be seen that the present invention has various unprecedented advantages, as enumerated below.

(1) Since a fresh toner tank included in a CTM is movable to a developing unit, the construction is simplified, the size is reduced, and the space is saved. In addition, the tank can be provided with a great capacity.

(2) When the fresh toner tank is located in the vicinity of a waste toner tank, it is held in an unmovable state. In the event of replacement of the CTM, the two tanks can be returned to the position where they adjoin each other. Further, since the two tanks can be replaced in an integral configuration, maintenance is facilitated.

(3) The CTM can be mounted to an electrophotographic apparatus accurately in a predetermined position, simplifying maintenance.

(4) A contact charger, whose ability falls due to aging, can be replaced periodically with the waste toner tank included in the CTM.

(5) A charge roller, or contact charger, remains in contact with the surface of a photoconductive drum stably and uniformly and can, therefore, charge the drum uniformly. This can be done without exerting an extra load on the drum while the drum is in rotation.

(6) A toner left on the drum after image transfer can be collected stably over a long period or time only if the number of magnets carried on a magnetic body is so selected as to set up an adequate toner collecting ability.

Various modifications will become possible for those skilled in the art after receiving the teachings of the present disclosure without departing from the scope thereof.

What is claimed is:

1. A cleaning device for cleaning a photoconductive element of an electrophotographic apparatus, comprising:

a cleaning mechanism held in contact with a surface of the photoconductive element of the electrophotographic apparatus, comprising:

a cleaning member held in contact with the surface of the photoconductive element for removing toner remaining on the surface of the photoconductive element;

a rotatable magnet body provided in close proximity to said cleaning member for causing the toner removed by said cleaning member to magnetically deposit on said magnet body, said rotatable magnet body including a cylindrical body with a cylindrical surface having a plurality of magnets on the cylindrical surface thereof;

a scraping member for scraping off the toner deposited on said magnet body; and a waste toner tank having an opening through which the toner removed by said cleaning member is collected, said magnet body blocking the opening of said waste toner tank such that the toner collected in said waste toner tank is prevented from flowing to the outside through the opening of said waste toner tank, and wherein each of said plurality of magnets is magnetized in a direction parallel to a direction of movement of the photoconductive element.

2. The cleaning device of claim 1 wherein said plurality of magnets comprises four magnets.

3. The cleaning device of claim 1, wherein the cleaning member comprises a cleaning blade.

4. A cleaning device for cleaning a photoconductive element of an electrophotographic apparatus, comprising:

a cleaning mechanism held in contact with a surface of the photoconductive element of the electrophotographic apparatus, comprising:

a cleaning member held in contact with the surface of the photoconductive element for removing toner remaining on the surface of the photoconductive element;

a rotatable magnet body provided in non-contact and close proximity to said cleaning member and in non-contact with the surface of the photoconductive element, and for causing the toner removed by said cleaning member to magnetically deposit on said magnet body, said rotatable magnet body including a plurality of magnets on a periphery thereof;

a scraping member for scraping off the toner deposited on said magnet body; and a waste toner tank having an external opening formed only around the magnet body through which the toner removed by said cleaning member is collected, said magnet body positioning said plurality of magnets for blocking the external opening of said waste toner tank such that the toner collected in said waste toner tank is prevented from flowing to the outside through the external opening of said waste toner tank.

5. The cleaning device of claim 4, wherein the cleaning member comprises a cleaning blade.

6. The cleaning device of claim 4, wherein said rotatable magnet body comprises a cylindrical body with a cylindrical surface having said plurality of magnets on the cylindrical periphery thereof.

7. The cleaning device of claim 6, wherein each of said plurality of magnets is magnetized in a direction parallel to a direction of movement of the photoconductive element.

8. The cleaning device of claim 6, wherein said plurality of magnets comprises four magnets.

* * * * *